US007419068B2

(12) United States Patent
Bushby

(10) Patent No.: US 7,419,068 B2
(45) Date of Patent: Sep. 2, 2008

(54) THERMOPLASTIC CAN

(76) Inventor: Maxwell Bushby, Unit 114, Huon Park 381 Bobbin Head Rd, North Turramurra, NSW (AU) 2074

( * ) Notice: Subject to any disclaimer, the term of this patent is extended or adjusted under 35 U.S.C. 154(b) by 568 days.

(21) Appl. No.: 10/500,398

(22) PCT Filed: Dec. 24, 2002

(86) PCT No.: PCT/AU02/01749

§ 371 (c)(1),
(2), (4) Date: Jun. 28, 2004

(87) PCT Pub. No.: WO03/055754

PCT Pub. Date: Jul. 10, 2003

(65) Prior Publication Data

US 2005/0247718 A1 Nov. 10, 2005

(30) Foreign Application Priority Data

Dec. 28, 2001 (AU) ..... PR9781

(51) Int. Cl.
*B65D 8/04* (2006.01)

(52) U.S. Cl. ..... 220/625

(58) Field of Classification Search ..... 220/615, 220/625, 610, 4.09, 623, 4.13, 4.12, 906; 206/407; 215/370
See application file for complete search history.

(56) References Cited

U.S. PATENT DOCUMENTS 1,104,096 A * 7/1914 Beatty et al. ..... 220/495
1,341,507 A * 5/1920 Jacobsson ..... 220/495.01
1,620,728 A * 3/1927 Jackson ..... 220/610
2,657,826 A * 11/1953 Ludowitz ..... 220/610
2,789,723 A * 4/1957 Perez ..... 220/561
3,288,342 A * 11/1966 Tinker ..... 229/5.6
3,485,436 A * 12/1969 Mirasol, Jr. ..... 229/123.2
3,558,001 A * 1/1971 Fritz et al. ..... 220/614
3,608,771 A * 9/1971 Monroe et al. ..... 220/266
3,858,162 A * 12/1974 Mai et al. ..... 439/612
3,878,963 A * 4/1975 Knize ..... 220/623
4,046,282 A * 9/1977 Ruch ..... 220/270
4,256,240 A * 3/1981 Woinarski ..... 220/782
4,353,761 A * 10/1982 Woerz et al. ..... 156/69
4,438,864 A * 3/1984 Helms ..... 220/265
4,440,321 A * 4/1984 Campbell et al. ..... 222/153.01
4,503,990 A * 3/1985 Roth et al. ..... 220/276
4,516,689 A * 5/1985 Barker ..... 222/556

(Continued)

*Primary Examiner*—Anthony D Stashick
*Assistant Examiner*—Robert J Hicks
(74) *Attorney, Agent, or Firm*—Galbreath Law Offices, P.C.; John A. Galbreath

(57) ABSTRACT

A thermoplastic can (1) comprising a thermoplastic body (2) having a disc like top (3) moulded as one with a tubular element (5) defining the sides of the body (2) and extending downwardly from the peripheral portions of the top (3); an openable portion associated with the top to facilitate use of the can contents by an end user, a thermoplastic base member (7) having an externally directed protrusion (8) engaged in a relatively thin walled recess (9) in the radially internally facing lower peripheral portion of the body thereby effecting a permanent seal at the base of the container after filling thereof; the resistance to permanent inward deformation of the externally directed protrusion exceeding the resistance to permanent outward deformation of the thin walled recess; the wall thickness of the lower peripheral portion of the body below the thin walled recess exceeding that of the thin walled recess.

11 Claims, 4 Drawing Sheets

U.S. PATENT DOCUMENTS 4,614,280 A * 9/1986 Wightman ..... 220/610
4,909,394 A * 3/1990 Stewart ..... 206/520
5,267,662 A * 12/1993 Hayes ..... 220/4.12
5,320,243 A * 6/1994 Hale ..... 220/495.01
5,503,289 A * 4/1996 Fox ..... 220/254.3
5,511,680 A * 4/1996 Kinne ..... 206/276
5,529,202 A * 6/1996 Shamis ..... 220/301
5,597,085 A * 1/1997 Rauworth et al. ..... 220/581
5,713,484 A * 2/1998 Setty ..... 220/790
5,967,875 A * 10/1999 Graef ..... 446/74
6,418,926 B1 * 7/2002 Chawla ..... 128/203.12
2002/0162845 A1 * 11/2002 Yeh ..... 220/625

* cited by examiner

THERMOPLASTIC CAN

BACKGROUND OF THE INVENTION

The present invention relates to a thermoplastic can and in particular a two piece bottom fill can wherein a permanent base to container seal is effected between a peripheral portion of the base and an internally facing surface adjacent to the lower extremity of the body of the can.

There are many applications where the advantages of a can, and particularly a thermoplastic can, have not yet been exploited due to the lack of a suitable container. For example oil is still commonly sold in bottles and furthermore many food products such as powders or even potato chips are sold in foil lined tubes which are relatively expensive and cumbersome to construct Of course steel cans are available but these are relatively expensive to produce compared with moulded thermoplastic articles. Thermoplastic cans would naturally have the advantage over and above a necked container such as a bottle for filling and ease of moulding if a satisfactory product was currently available. A necked bottle involves a lengthy mould cycle as compared with an open necked thermoplastic container.

To date however no satisfactory thermoplastic can has yet been proposed probably due to the difficulty of effecting a satisfactory seal between an open neck and a closure.

BRIEF SUMMARY OF THE INVENTION

It is accordingly an object of the present invention to ameliorate one or more of the above mentioned difficulties with existing containers or at least to provide the market with an alternative.

According to the present invention there is provided a thermoplastic can comprising a thermoplastic body having a disc like top moulded as one with a tubular element defining the sides of the body and extending downwardly from the peripheral portions of the top; means associated with the top to facilitate opening by an end user, a thermoplastic base member having an externally directed protrusion adapted to engage a relatively thin walled recess in the radially internally facing lower peripheral portion of the body thereby effecting a permanent seal at the base of the container after filling thereof, the wall thickness of the lower peripheral portion of the body below the thin walled recess exceeding that of the thin walled recess.

One embodiment of the present invention will now be described with reference to the accompanying drawings in which:

DETAILED DESCRIPTION OF THE INVENTION

Figures 1, 3:
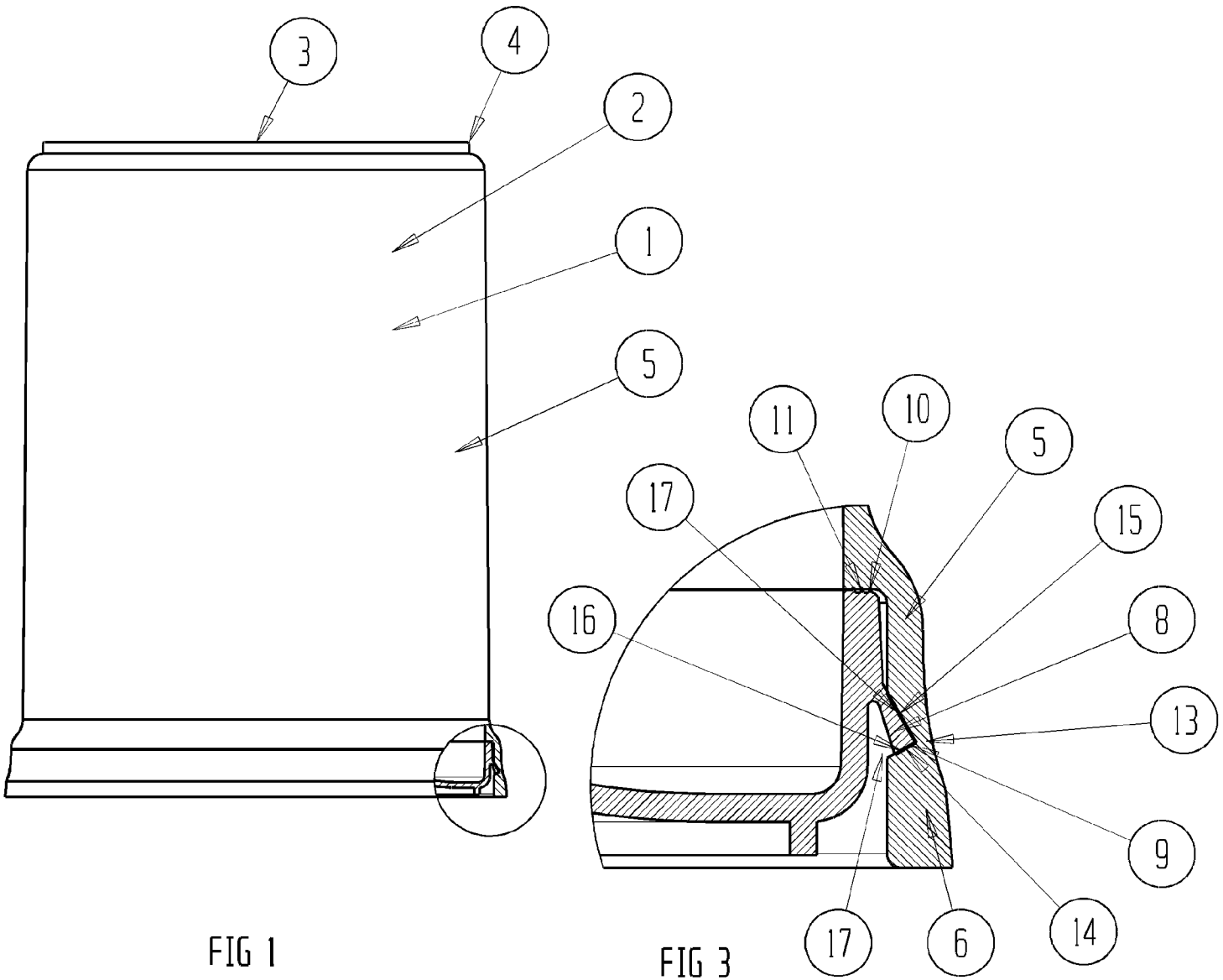
FIG. 1 is a side elevation of a can in accordance with the present invention.
FIG. 3 is a detail of a lower peripheral portion of the can of FIG. 1 in section.
Figure 2:
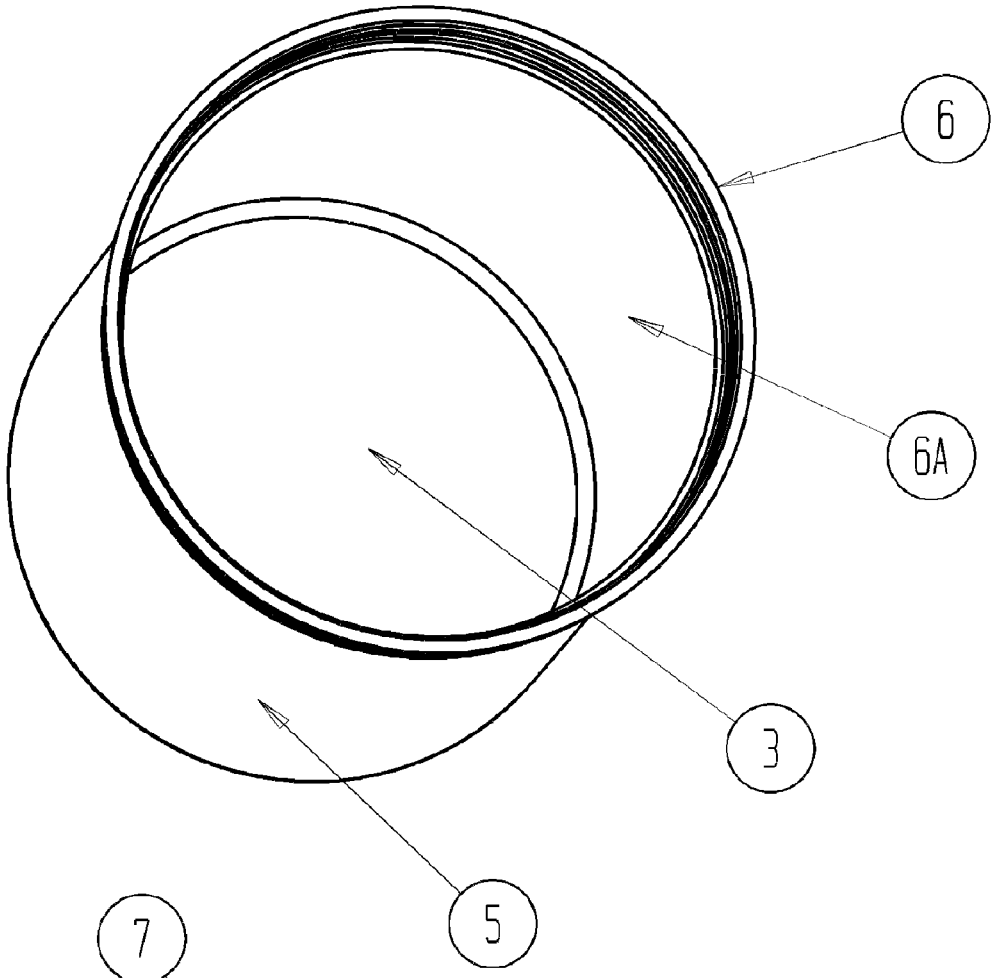
FIG. 2 is a perspective view of a can in accordance with FIG. 1.

With reference now to FIG. 1 there is disclosed a container 1 having a thermoplastic body portion 2 comprising a disc like top portion 3 being unitary with and extending adjacent its peripheral edges 4 into a tubular element 5 to form a container having an opening 6*a* through which fast filling of the can is possible utilising automated machinery (not shown).

Figure 4:
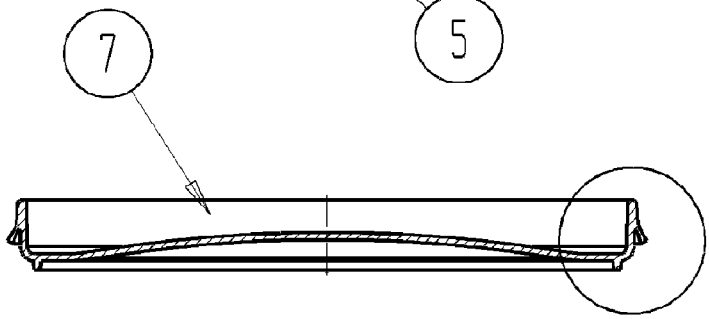
FIG. 4 is a side elevation of a base for sealing engagement with the can of FIGS. 1 and 2.
Figure 5:
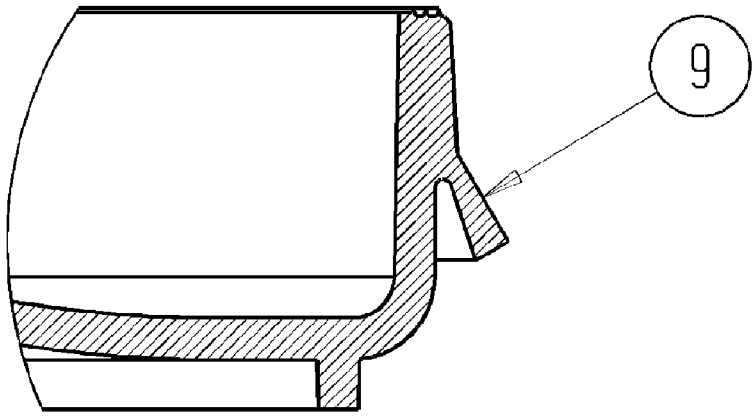
FIG. 5 is a detailed view of the circled area in FIG. 4 that is, a detailed view of the peripheral edge of the base showing the protrusion.
Figure 7:
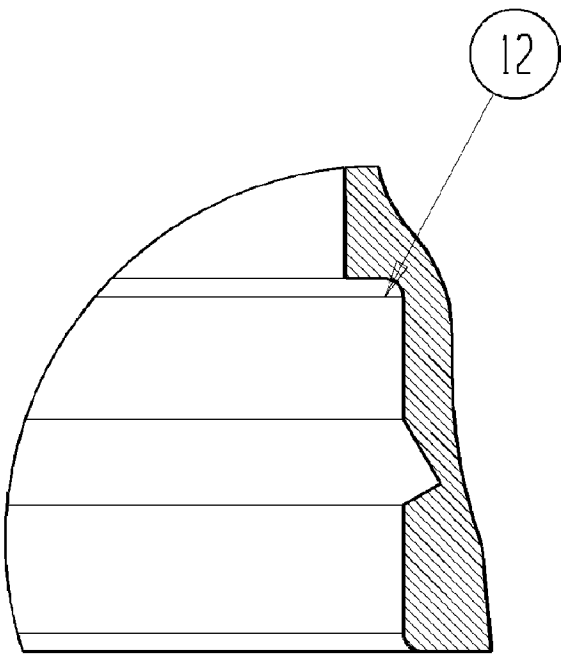
FIG. 7 is a detail view of the circled area in FIG. 6 that is, a detailed view of the lower peripheral portion of the tubular element showing the arcuate recess.
Figure 6:
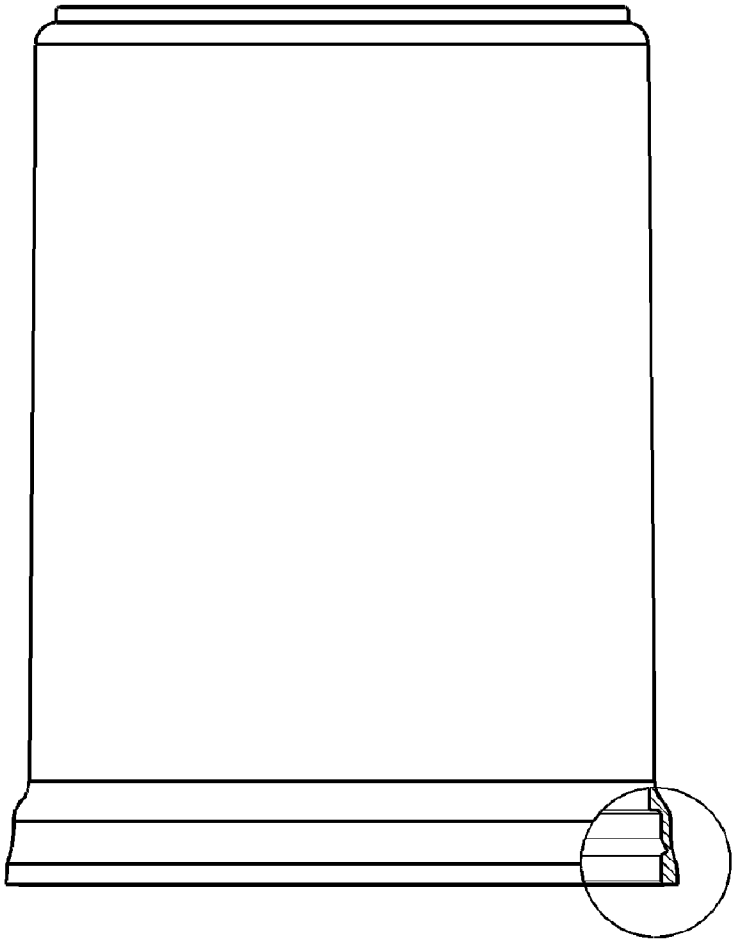
FIG. 6 is a side elevation of a can in accordance with the present invention, without the base being shown.

With reference to FIG. 4 there is disclosed a base 7 adapted to fit within opening 6*a* to effect a permanent sealing of that opening.

The lower peripheral portion of tubular element 5 and the outer peripheral portion of base 7 are responsible for effecting a seal when base 7 lies within opening 6*a* as depicted in part section in FIG. 3.

With reference now to FIG. 3 it will be observed that base 7 is provided with an externally and downwardly directed annular protrusion 8 which during insertion of base 7 into opening 6*a* of tubular element 5 rides over and within the bottom of lower extremity 6 of the tubular element and then expands radially outwardly to jump into recess 9 above the bottom of lower extremity 6.

It will be observed that the wall of the lower extremity 6 of tubular element 5 adjacent recess 9 is considerably thinner than the thickness of the bottom of lower extremity 6 of tubular element 5 therebeneath. This differential in thickness of the wall at the positions adjacent to the seal between recess 9 and protrusion 8 and therebeneath permits minor radially outward movement of the thin walled area of the recess 9 and also radially inward creeping of the thicker walled area beneath the undercut due to the superior "memory" of the thermoplastic material at the thicker walled area of lower extremity 6 as compared with the thinner walled area of the extremity adjacent recess 9 after insertion of protrusion 8. The difference in memory is due to the fact that the thinner walled area is subject to some plastic deformation as opposed to the more elastic deformation of the thicker walled area Polyolefins, PET and PEN will exhibit this useful behaviour. During installation of base 7 into opening 6*a* initially the bottom of lower extremity 6 of tubular element 5 tends to move radially outwardly. The post base installation movements tend to increase the integrity of the seal formed at the recess 9. In this embodiment a secondary seal is also effected at 10 by the containment of flexible upper annular peripheral extension 11 of base 7 within arcuate recess 12 in tubular element 5. This secondary seal can adopt a number of forms although it is envisaged that it will commonly take the form of a collapsible membrane or compressed pyramid shaped sealing ring moulded into the base 7 and being compressed when the base is inserted into tubular element 5.

In order for the thin walled area of lower extremity 6 of tubular element 5 to deform outwardly during installation of the base and thereafter it is desirable that the wall of the element at this point be between 0.15 mm and 0.7 mm.

Clearly for an adequate seal to result the materials of construction, thickness and profile of the thin walled area and the protrusion 8 need to be such that the thin walled area has a lesser resistance to plastic deformation that of the protrusion 8.

The outermost edge 13 of protrusion 8 which is responsible for biting into the thin walled area of recess 9 may vary in profile but preferably it should have a radius of between zero and two mm. Faces 14 and 15 of recess 9 must of course be angled and shaped so as to be complementary to the protrusion faces 6 and 17 respectively as well as outermost edge 13 of protrusion 8 to facilitate an adequate seal.

Ideally the relationship between the faces 16 of protrusion 8 and the face 14 of the recess 9 should be such as to provide for an interference of approximately 0.05 mm at all points around the periphery of the base 7. In the embodiment depicted herein the outermost edge 13 extends into a flat inclined surface 14 therebeneath and in such embodiments it is desirable that such flat edge 14 lies an angle between 15 to 45 degrees (and preferably between 24 to 32 degrees) from the vertical and mates with similarly inclined surface 16 in recess 9.

Ideally the protrusion 8 itself extends and downwardly towards its radially outward extremity so as to form an angle of between 20 and 45 degrees with the vertical as measured in undercut area 18.

It will be appreciated therefore that the embodiment depicted with reference to FIG. 3 contains a secondary seal at 10 and a primary seal at recess 9 with the seal effected at recess 9 also comprising a mechanical interference fit which prevents removal of the base 7 after sealing of the open base of the can 1.

The tubular body 5 of the can needed not necessarily be circular in cross section but may also be for example rectangular, square, oval or oblong.

Recess 9 is formed as an annular groove moulded into the lower opening of the tubular body 5 of the can which allows outwardly extending protrusion 8 on the base 7 to nest therein when pushed by means of a plattem through the thick walled mouth comprising the opening in the body 5. The maximum diameter of protrusion 8 is of course larger than the maximum diameter of recess 9 to which it is fitted. This interference is critical to the seal of the can The interference depends on the capacity and size of can produced but is preferably in the range of 0.1 mm to 0.7 mm.

The can is of course provided with opening means for use by a consumer in upper disc 3. This may comprise a scored area provided with a ring pull in order to facilitate removal of part or most of the top of the can or indeed any other known method for opening a thermoplastic container. For example in respect of oil containers the container may be opened by spearing a steel spike into the top of the container which spike may comprise a spout.

Whatever the configuration of the seal between the base and the body of the container it will be appreciated that the large opening of a two piece can is available to facilitate quick filling prior to sealing of the base and furthermore the mould cycle time of an open container as distinct from a bottle type container is significantly reduced. The reduction in this cycle time is significant as cycle times in connection with thermoplastic necked bottles are in the order of fourteen to sixteen seconds whereas the mould cycle time for a can body in accordance with the present invention is approximately six to ten seconds. Alternate sealing arrangements apart from those depicted in FIG. 3 may be devised without departing from the scope and intendment of the present invention.

The invention claimed is:

1. A thermoplastic can comprising a thermoplastic body having a disc like top moulded as one with a tubular element defining the sides of the body and extending downwardly from the peripheral portions of the top; means associated with the top to facilitate opening by an end user; a thermoplastic base member having an externally directed protrusion adapted to engage a relatively thin walled recess in the radially internally facing lower peripheral portion of the body thereby effecting a permanent seal at the base of the container after filling thereof; the resistance to permanent inward deformation of the externally directed protrusion exceeding the resistance to permanent outward deformation of the thin walled recess; the wall thickness of the lower peripheral portion of the body below the thin walled recess exceeding that of the thin walled recess prior to said deformation.

2. A thermoplastic can in accordance with claim 1 hereof wherein the externally directed protrusion extends externally and downwardly and is therefore capable of flexing inwardly whilst being introduced into the body of the can prior to coming to rest in the thin walled recess.

3. A thermoplastic can in accordance with claim 1 hereof wherein the externally directed protrusion extends externally and downwardly and is therefore capable of flexing inwardly whilst being introduced into the body of the can prior to coming to rest in the thin walled recess; the radially innermost side of the protrusion defining with the adjacent surface of the base an undercut, the included angle of the undercut being between 20 and 45 degrees.

4. A thermoplastic can in accordance with claim 1 hereof wherein the resistance to permanent inward deformation of the externally directed protrusion exceeds the resistance to permanent outward deformation of the thin walled recess due to the fact that the radially externally directed protrusion is fabricated from thicker thermoplastic material than that present in the thin walled recess.

5. A thermoplastic can in accordance with claim 1 hereof wherein the base-body interface is provided with a secondary seal apart from that effected by the externally directed protrusion nesting in the thin walled recess; this secondary seal being effected by one or more resiliently deformable annular protrusions from the base contacting the body and deforming thereagainst so as to form a seal when the externally directed protrusion nests in the thin walled recess so as to form the primary seal.

6. A thermoplastic can in accordance with claim 1 hereof wherein the base-body interface is provided with a secondary seal apart from that effected by the externally directed protrusion nesting in the thin walled recess; this secondary seal being effected by one or more resiliently deformable annular protrusions from the body contacting the base and deforming thereagainst so as to form a seal when the externally directed protrusion nests in the thin walled recess so as to form the primary seal.

7. A thermoplastic can in accordance with claim 1 hereof wherein the tubular body or the base or both are fabricated from a Polyolefin such as PET or PEN.

8. A thermoplastic can in accordance with claim 1 hereof wherein the interference between the radially outermost extremity of the protrusion and the recess in the thin walled section of the body is in the range of 0.1 mm to 0.7 mm.

9. A thermoplastic can in accordance with claim 1 hereof wherein the interference between them the lowermost surface of the protrusion and that complementary surface of the recess in the can body against which it is intended to seal is between 0.03 mm and 0.08 mm.

10. A thermoplastic can in accordance with claim 1 hereof wherein the radially outermost extremity of the protrusion has a relatively sharp edge exhibiting a radius of between zero and 2.5 mm.

11. A thermoplastic can in accordance with claim 1 hereof wherein the wall thickness of the lower peripheral portion of the body below the thin walled recess exceeds and the minimum wall thickness of the thin walled recess by least 20 per cent.

* * * * *